United States Patent [19]

Brandl et al.

[11] Patent Number: 4,501,189

[45] Date of Patent: Feb. 26, 1985

[54] SILENCED HAND-HELD FIREARM WITH ROTATING TUBE AND SLEEVE

[75] Inventors: Rudolf Brandl, Dornhan; Herbert Doll, Oberndorf, both of Fed. Rep. of Germany

[73] Assignee: Heckler & Koch GmbH, Oberndorf, Fed. Rep. of Germany

[21] Appl. No.: 402,267

[22] Filed: Jul. 27, 1982

[30] Foreign Application Priority Data

Aug. 7, 1981 [DE] Fed. Rep. of Germany ..... 3131265

[51] Int. Cl.[3] ..... F41F 17/12

[52] U.S. Cl. ..... 89/14.4; 181/223

[58] Field of Search ..... 89/14 D, 14 B, 14 C, 89/14 R; 42/79; 181/223

[56] References Cited

U.S. PATENT DOCUMENTS

| | | | |
|---|---|---|---|
| 1,598,360 | 8/1926 | Pavek | 89/14 C X |
| 2,212,687 | 8/1940 | Hughes | 89/14 E |
| 2,451,514 | 10/1948 | Sieg | 89/14 C |
| 3,187,633 | 6/1965 | Tanabe | 89/14 C |
| 3,380,344 | 4/1968 | Bucklisch et al. | 89/14 C |
| 3,730,050 | 5/1973 | Goldin et al. | 89/14 R |
| 3,858,481 | 1/1975 | Elliott | 89/14 C |
| 4,384,507 | 5/1983 | Finn | 89/14 D |

FOREIGN PATENT DOCUMENTS

| | | |
|---|---|---|
| 361004 | 10/1922 | Fed. Rep. of Germany . |
| 2542758 | 4/1977 | Fed. Rep. of Germany . |
| 564881 | 1/1924 | France . |
| 891602 | 3/1944 | France . |
| 954475 | 12/1949 | France . |
| 240479 | 4/1946 | Switzerland . |
| 1547562 | 6/1979 | United Kingdom . |

*Primary Examiner*—Stephen C. Bentley
*Assistant Examiner*—John S. Maples
*Attorney, Agent, or Firm*—Leydig, Voit, Osann, Mayer and Holt, Ltd.

[57] ABSTRACT

The invention relates to a hand-held firearm comprising a muzzle silencer (9) and a barrel (11) which is provided with transverse bores and is surrounded by an expansion area (15) into which the transverse bores extend. The transverse bores (14) enable the muzzle velocity of the bullets to be less than Mach 1, in spite of the use of conventional ammunition, and there is consequently no supersonic boom of the bullet. To selectively eliminate the reduction in firing energy involved therein and be able to shoot with maximum firing force, the transverse bores (14) are selectively closable by a locking device (16) which is preferably in the form of a sleeve (16) which surrounds the barrel (11) and is mounted for rotation thereon and is furthermore provided with an actuating member (21) for setting the open or closed position. The actuating member may take the form of a tube section (21) surrounding the barrel (11) in spaced relationship thereto at least over part of its length and delimiting the expansion area (15), with its both ends connected with the barrel in sealed relationship and mounted on the barrel (11) for rotation. The tube section is connected with the sleeve (16) for rotation therewith (FIG. 2).

6 Claims, 5 Drawing Figures

SILENCED HAND-HELD FIREARM WITH ROTATING TUBE AND SLEEVE

The invention relates to an automatic hand-held firearm comprising a muzzle silencer and a barrel which is provided with at least one transverse bore extending transversely therethrough and is surrounded by an expansion area into which the transverse bores extend.

Silenced hand-held firearms are required for special assignments, for example, commando raids. Here, three main sources of noise must be differentiated from one another, namely the muzzle blast caused by the expansion of the gases when the bullet has left the barrel, the blast caused by the bullet travelling at supersonic speed, and the mechanical sound of the movement of the locking system which is generally masked by the first two aforementioned noises. The muzzle blast is strongly reduced by a muzzle silencer in known hand-held firearms. The bullet blast is eliminated by the bullet leaving the barrel not at supersonic speed, but at subsonic speed. The reduction in energy involved therein is tolerated in commando raids where fighting only takes place at a short distance anyhow. The locking sound can be reduced by treating the cooperating parts appropriately.

The use of such weapons, known, for example, as MP 5 SD, is, however, limited to special cases, and the weapon is not suitable for normal use because the firing energy is reduced to too great an extent due to the decrease in the firing speed. In this case, the reduction in firing speed is not obtained by a decrease in the propelling charge, but rather, when conventional ammunition is used, the firing speed is reduced by the barrel being provided with transverse bores extending into an expansion area which surrounds the barrel and is closed off in an outward direction.

In many instances, there is a need for not only silenced and energy reduced hand-held firearms to be available for special assignments and commando raids, but also hand-held firearms with maximum firing energy should be available for use. Hitherto, it has been necessary to take along various weapons, which hampers the execution of such maneuver considerably.

The object of the present invention is to so construct a silenced hand-held firearm of the kind mentioned at the outset that it selectively also enables shots to be fired at least approximately at the maximum, normal muzzle speed.

This object is attained in accordance with the invention with a hand-held firearm of the kind mentioned at the outset by provision of a locking device for selectively blocking the path from the transverse bore to the expansion area.

In this, in principle, astonishingly simple way, which does, however, involve practical difficulties, the silenced hand-held firearm can be used with both a high degree of silencing (elimination of muzzle blast and bullet blast) and a low degree of silencing (elimination of only the muzzle blast), with the advantage of the maximum firing energy and break-through force being gained in the latter case. This double employment possibility of the weapon is advantageous in special assignments and commando raids when, after termination of the first phases, there is no need for the increased silencing, and instead of that an increase in the firing power is desirable. Since it is not possible for a plurality of weapons to be taken along on commando raids, the hand-held firearm according to the invention is particularly well suited since it satisfies a longstanding need.

The locking device can vary in technical design. In an embodiment of the invention, the locking device is in the form of a sleeve which surrounds the barrel and is mounted for rotation thereon and which is furthermore provided with an actuating member for setting the open or closed position. The locking device is therefore a kind of rotary slide valve.

The muzzle silencer, which is provided in any case, may, for example, serve as expansion area. This does, however, require that the gas be conducted from the sleeve to the muzzle silencer in an appropriate manner. In order to avoid the operational and structural difficulties caused by such a relatively lengthy conducting of the gas, the expansion area in a preferred embodiment of the invention is delimited by a tube section surrounding the barrel in spaced relationship thereto over at least part of its length, with its two ends connected with the barrel in sealed relationship thereto. If necessary, however, a connection to the muzzle silencer can be established. Such an expansion area has sufficient volume and is compatible with the weapon.

There are different ways of bringing the sleeve into the open or closed position, for example, by way of a protruding actuating member in the form of a radial handle or the like. It is, however, preferable to rotatably mount the tube section on the barrel for rotation with the sleeve. The tube section delimiting the expansion area therefore simultaneously serves as actuating member for switching the sleeve into the open or closed position. The main advantage in this case is that, on the one hand, sufficient adjustment force can be applied to the sleeve on account of the adequate diameter of the tube section, and, on the other hand, no protruding levers or fittings which might have an inconveniencing or hindering effect are required for actuating the sleeve.

According to a preferred embodiment of the invention, the upper inside surface of the sleeve has longitudinal grooves formed therein which at one end extend into transverse bores penetrating the sleeve wall and whose other end extends as far as the area of the bores formed in the barrel. The transverse bores therefore form together with the longitudinal grooves a connection system leading from the barrel through its transverse bores into the expansion area.

A screw or pin connection may, for example, be used to connect the tube section and the sleeve for rotation with one another, which does, however, not enable a speedy release. According to a preferred embodiment of the invention, on the other hand, the tube section is connected with the sleeve through a positive coupling which is disengageable by axial displacement. The coupling consists of an external toothed ring on the sleeve and an internal toothed ring on the tube section which fit together. Such a coupling transfers the forces occurring reliably and is easy to take apart and put together again.

In a preferred embodiment of the invention, the tube section is mountable together with the adjacent muzzle silencer in front of the barrel muzzle. The tube section and the muzzle silencer are therefore mounted as one unit. This has, above all, handling advantages because the muzzle silencer, the tube section and the sleeve are mostly used together in any case.

For this purpose, the tube section and the muzzle silencer are preferably provided with a common connecting member connectable with the barrel in the barrel muzzle area as a type of bayonet joint. Such a bayonet joint establishes a connection by a combination of a sliding and a turning motion. Bayonet connections are comprised of components known per se in technology.

Embodiments of the invention are shown in a simplified and schematic presentation in the drawings which will now be explained. Details which are not essential to understanding the invention have been omitted.

Figure 1:
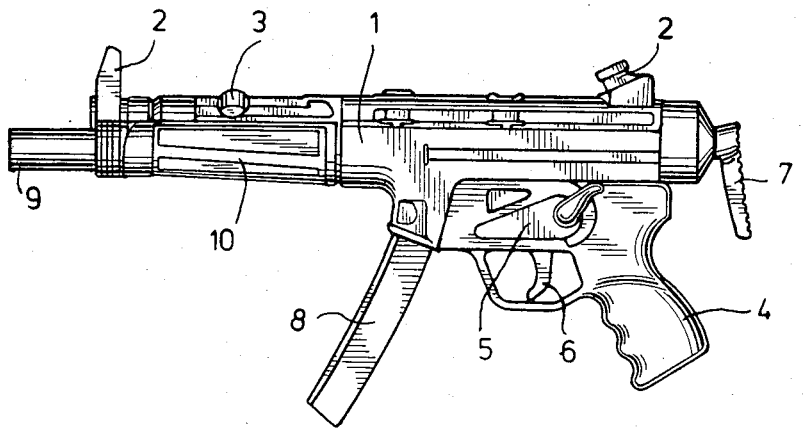
FIG. 1 is a first embodiment of a weapon with a muzzle silencer mounted thereon.

The submachine gun shown in FIG. 1 comprises a housing 1 with a hand guard 10 covering the barrel, a sight 2 and a loading device 3. The weapon further comprises a gun handle 4 with a trigger case 5 and a trigger 6, a shoulder rest 7, a straight magazine 8 and a muzzle silencer 9 mounted on the muzzle of the barrel. The weapon illustrated in FIG. 1 is known (MP 5 SD 3 of Heckler & Koch GmbH).

Figure 2:
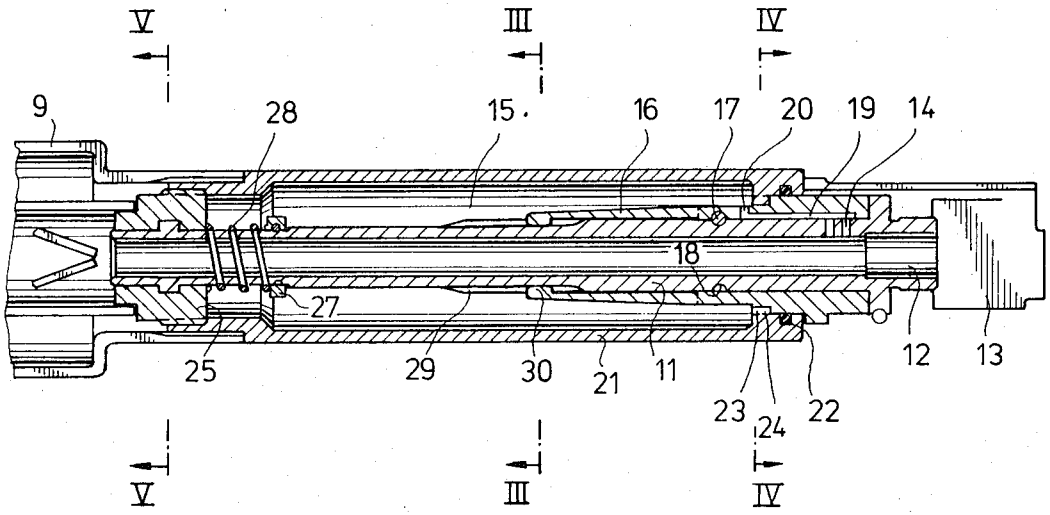
FIG. 2 is a partial longitudinal section taken through the barrel and the adjacent parts serving to silence the weapon as shown in FIG. 1.

In accordance with FIG. 2, a barrel 11 comprising a cartridge chamber 12 at its rear end is sealed off by a closure means 13 which is merely indicated in the drawing. At a small distance in front of the cartridge chamber 12 transverse bores 14 extending through the barrel wall are formed in the barrel. After firing, propellant gas enters an expansion area 15 through these transverse bores 14, whereby the energy imparted to the ammunition, even if conventional, is reduced to such an extent that the muzzle speed of the ammunition is below the speed of sound, with the result that the bang (supersonic boom of the bullet) is eliminated.

Figure 4:
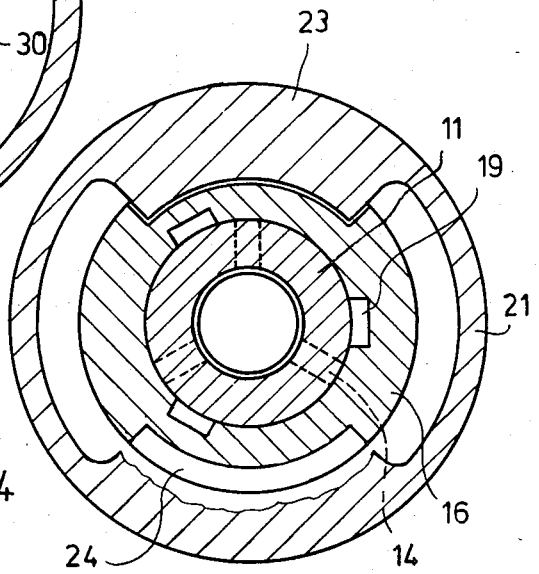

In order to cut off this connection, if desired, so that a shot can be fired with the maximum firing energy, a sleeve 16 is mounted for limited rotation on the barrel 11, more particularly, fixed axially by a transverse pin 17 engaging an external circumference annular groove 18. There are provided in the inside surface of the sleeve 16, distributed uniformly over the circumference, three longitudinal channels 19 which at their end facing the barrel muzzle verge into transverse bores 20 extending through the sleeve wall into the expansion area 15. When the sleeve 16 is in a certain angular position with respect to the barrel 11, the ends of the channels 19 adjacent the closure means 13 each cover one of the transverse bores 14. If, on the other hand, the sleeve 6 is pivoted from this position by, for example, 30°, as shown in FIG. 4, the longitudinal channels 19 are then offset tangentially with respect to the transverse bores 14 and the latter are thereby closed. If the sleeve and the barrel are to be sealed off from one another, the surfaces opposite each other can take the form of a kind of labyrinth seal.

The expansion area 15 is delimited in an outward direction by a tube section 21 which in the area adjacent the closure means 13 is adapted to be slid onto the sleeve 16, with a sealing ring 22 being inserted in an annular groove. The tube section 21 is provided with an internal toothing 23 and the sleeve 16 with an external toothing 24 which engage when the tube section 21 is positioned on the sleeve. Therefore, when the tube section 21 is turned, the sleeve 16 is also turned. The other end of the tube section 21 adjacent the muzzle of the barrel 11 is closed off by a ring 25 to which the end of the muzzle silencer 9 facing the closure means 13 is also secured. The ring 25 is axially mountable on the muzzle area of the barrel 11 and, limited by a pin 26, pivotable about a predetermined angle. Within the expansion area 15 there is secured to the barrel a supporting ring 27 and abutting the latter a helical pressure spring 28, which, in turn, is supported at the side of the ring 25 facing it. The spring 28 presses the ring 25 and thus the tube section 21 in the direction of fire when the tube section 21 is not secured by a bayonet catch 32/33 which is formed in ring 25 and barrel 11, and whose pivot angle is limited by the pin 26.

Figure 3:
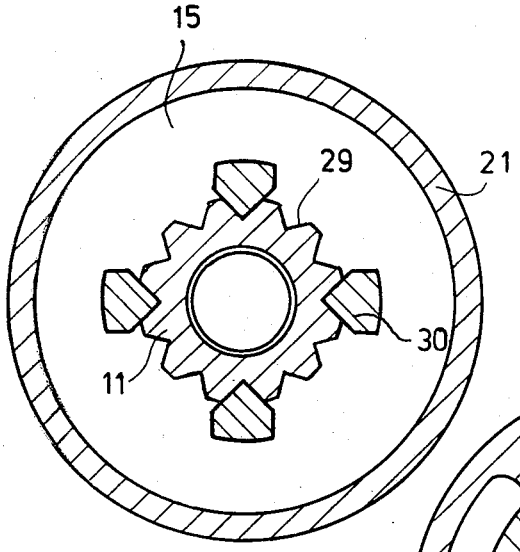
FIGS. 3, 4 and 5 are cross-sections according to lines III—III, IV, and V—V of FIG. 2.
Figure 5:
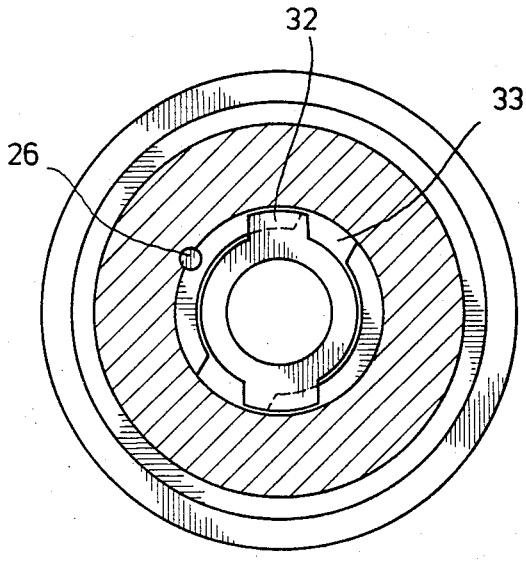

The barrel 11 comprises on its exterior surface, in the area of the front end of the sleeve 16, longitudinal grooves 29 which, when the sleeve 16 is mounted, receive its axial ridges 30 and thus set the radial relative position of the sleeve 16 with respect to the barrel 11. The lock position shown in FIGS. 3, 4 and 5—in each case the same—corresponds to the position for unreduced maximum firing energy: the transverse bores 14 are covered by the sleeve 16. If by now turning the tube section 21, the sleeve 16 is made to move along by the toothing 23/24, then the turning in the clockwise direction causes the transverse bores 14 to be covered by the channels 19, which corresponds to the position for reduced firing energy. In the case of counterclockwise turning, the channels 19 remain covered by the sleeve 16—at the ring 25 and barrel 11 the setting members return to the initial position and the muzzle silencer 9 can be removed axially together with the tube section 21 from the barrel 11, in which case the toothing 23/24 disengages. Since the tube section 21 may undergo an increase in temperature when bursts of shots are fired, the hand guard 10 which covers the tube section 21 and is preferably mounted for rotation on the tube section 21 is usually attached.

If single shots are fired, the expansion area 15 could be emptied through the transverse bores 20, the longitudinal channels 19 and the transverse bores 14, the barrel bore and the muzzle silencer 9 in an outward direction. However, if bursts of shots are fired, this is not possible, and the ring 25 is therefore provided with an axial bore to establish a direct connection from the expansion area 15 to the interior of the muzzle silencer 9 whose interior, for its part, is outwardly ventilated in a manner known per se.

The reference numerals in the patent claims do not constitute a limitation, but are merely to enable a better understanding of the invention.

We claim:

1. A hand-held firearm comprising:

a muzzle silencer;

a barrel having at least one transverse bore;

a tube section mounted for rotation on said barrel and surrounding said barrel being spaced therefrom at least over part of the length of said tube section to define an expansion area, both ends of said tube section being connected to the barrel in a sealed relationship thereto;

a path connecting said transverse bore and said expansion area;

means for selectively blocking said path, including a sleeve surrounding the barrel and mounted for rotation thereon, said sleeve having a first position in which said path is open and a second position in which said path is closed;

a positive coupling connecting said tube section to the sleeve for rotation therewith, said coupling being disengageable upon forward axial displacement of said tube section and sleeve relative to said barrel;

a connecting member closing an end of the tube section adjacent to the muzzle of the barrel;

means connecting said connecting member and tube section with the barrel and having a first rotational position corresponding to the first position of said sleeve in which said tube section is locked to the barrel and a second rotational position corresponding to the second position of said sleeve in which said tube section can be removed from the barrel upon forward axial movement relative thereto, whereby when the tube section is in rotational position to be disconnected from the barrel by forward axial movement, the sleeve is in position closing the path from the transverse bore to the expansion area, and when the tube section is in rotational position locked to the barrel, the sleeve is in position opening the path from the transverse bore to the expansion area.

2. A hand-held firearm according to claim 1 wherein said muzzle silencer is connected to the connecting member and said tube section for mounting together on the barrel of the firearm.

3. A hand-held firearm as claimed in claim 1, wherein said path includes transverse bores penetrating the sleeve wall and longitudinal channels formed on the inside surface of said sleeve and connecting said transverse bores with said transverse bore in the barrel when the sleeve is in the first open position.

4. A hand-held firearm as claimed in claim 1, wherein said muzzle silencer is mounted adjoining said tube section in front of the barrel muzzle.

5. A hand-held firearm as claimed in claim 1, including a hand guard surrounding said tube section.

6. A hand-held firearm according to claim 1, including a path between said expansion area and said muzzle silencer for emptying the expansion area through the muzzle silencer.

* * * * *